US006848761B2

(12) United States Patent
Salice

(10) Patent No.: US 6,848,761 B2
(45) Date of Patent: Feb. 1, 2005

(54) PULLOUT GUIDE FOR A DRAWER

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 10/143,346

(22) Filed: May 10, 2002

(65) Prior Publication Data

US 2002/0190618 A1 Dec. 19, 2002

(30) Foreign Application Priority Data

May 10, 2001 (DE) ..... 201 07 905 U
Jul. 3, 2001 (DE) ..... 201 11 017 U

(51) Int. Cl.[7] ..... A47B 88/00

(52) U.S. Cl. ..... 312/334.4; 312/334.15; 312/334.18; 384/19; 384/22

(58) Field of Search ..... 312/334.4, 334.12, 312/334.15, 334.18, 334.39, 348.1, 348.4; 384/19, 22

(56) References Cited

U.S. PATENT DOCUMENTS 4,165,907 A * 8/1979 Rock et al. ..... 384/19
4,564,248 A * 1/1986 Grass ..... 384/19
4,615,572 A * 10/1986 Nelson ..... 312/334.4
5,653,518 A * 8/1997 Hardt ..... 312/334.4
5,688,033 A * 11/1997 Fleisch et al. ..... 312/348.4
5,692,816 A * 12/1997 Lai ..... 312/334.4
5,876,103 A * 3/1999 Domenig ..... 312/334.4

FOREIGN PATENT DOCUMENTS

| | | | |
|---|---|---|---|
| AT | 328127 | 5/1975 | |
| DE | 6934139 | 1/1970 | |
| DE | 2432329 | 12/1975 | |
| DE | 2752779 | 6/1978 | |
| DE | 3120840 A1 * | 9/1982 | ..... A47B/88/00 |
| DE | 3221073 A1 * | 12/1983 | ..... A47B/88/00 |
| DE | 3405802 | 9/1984 | |
| DE | 19957072 | 6/2001 | |
| DE | 20107905 | 7/2001 | |
| EP | 0406703 | 1/1991 | |
| HU | 188980 | 5/1985 | |
| HU | 193475 | 2/1987 | |
| HU | 211355 | 6/1993 | |

* cited by examiner

*Primary Examiner*—Kimberly Wood
(74) *Attorney, Agent, or Firm*—Dilworth & Barrese LLP

(57) ABSTRACT

A pullout guide for a drawer consists of two carrier rails on the body side which carry rollers rotatably supported around horizontal axes and having two pullout rails on the drawer side whose horizontal runways bent from the upper sides of the vertical webs are supported at their lower support surfaces on at least the two rollers of the carrier rails disposed in the region of the front side of the body part. To allow a vertical adjustment of the front board of the drawer in a simple manner, the horizontal runways are provided at their front end regions with sections which can be pivoted or vertically moved by adjustment devices.

13 Claims, 9 Drawing Sheets

PULLOUT GUIDE FOR A DRAWER

BACKGROUND OF THE INVENTION

The invention relates to a pullout guide for a drawer having two carrier rails on the body side which carry rollers, which are rotatably supported about horizontal axes, and having two pullout rails on the drawer side whose horizontal runways bent from the upper sides of their vertical webs are supported on at least the two rollers of the carrier rails disposed in the region of the front side of the body part.

Such a pullout guide for a drawer is known, for example, from EP 0 406 703 A1. Drawers are usually parts of pieces of furniture which include a plurality of drawers and/or flaps and doors so that the front side walls or front covers of the drawers have to be aligned with respect to one another and, where necessary, to the doors or flaps so that equally large gaps or spacings are formed between them. Due to unavoidable production tolerances, it is necessary to design the front sides or front covers of the drawers to be vertically adjustable in order to set the desired spacings to other parts of pieces of furniture. In the pullout guide for drawers known from EP 0 406 703 A1, such an adjustability is not provided.

A pullout guide for drawers is known from DE 27 52 779 C2 in which the front boards of the drawers can be vertically adjusted in that a vertically adjustable stop with a run-on surface for the running on web of the other rail is provided which can be vertically adjusted by swivelling. The known vertically adjustable stop causes a comparatively complex construction and forms a stop against which the rail strikes with an audible abutment.

SUMMARY OF THE INVENTION

It is the object of the invention to provide a pullout guide for a drawer which allows a vertical adjustment of the front board of the drawer in a simple manner.

This object is solved in accordance with the invention in that the horizontal runways are provided at their front end regions with sections which can be pivoted or vertically travelled by adjustment devices. The pullout guide in accordance with the invention makes possible a vertical adjustment of the front board of the drawer in a simple manner in that the front end regions of the horizontal runways are vertically adjustable by adjustment devices.

In accordance with a preferred embodiment, it is provided that each front end region of the horizontal runways is cut out from the vertical webs of the pullout rails and is provided with an adjustment device by which the cut-out end region of each runway can be pivoted relative to the vertical web. The pullout guide in accordance with the invention allows a simple vertical adjustment of the front board of each drawer in that the cut-out section of each pullout rail is pivoted by the required amount. The incline of the horizontal runways is changed in a continuous manner by this pivoting, without abutments arising which cause unwanted noises.

The adjustment device can, for example, consist of an adjusting screw which is connected rotatably, but undisplaceably in the axial direction, to the vertical web of the pullout rail and is screwed into a tapped bore of the cut-out part of the horizontal runway. In accordance with a preferred embodiment, it is provided that the adjustment device consists of a slider which is displaceable transversely to each pullout rail and which is provided with a groove encompassing the end region of the cut-out section of the runway and with a displacement device.

The slider is appropriately guided between lateral guide webs of a guide piece connected to the pullout rail and provided with a transversely extending elongate opening whose sides encompass a cylindrical disc which is eccentrically secured to a shaft which is connected to the guide piece rotatably, but axially undisplaceably.

In accordance with a second preferred embodiment, it is provided that each of the front end regions of the horizontal runways is removed by a cutting out and a flat, housing-like end piece having a lower support surface which extends obliquely upwardly is connected to each of the vertical webs of the pullout rails and, adjoining the support surface of the bent horizontal runway, continues this, and that a slider is vertically adjustably guided in the end piece by an adjustment device such that this can be downwardly travelled out beyond the support surface of the end piece and thereby forms a vertically adjustable support surface.

The end piece is appropriately provided with a recess corresponding to the contour of the slider and the slider is guided in said recess.

A shaft provided with a head is preferably rotatably supported on a side wall of the end piece bounding the recess, with the shaft having an eccentric section which passes through a matched, window-like aperture of the slider. This aspect allows a vertical adjustment of the slider by a simple turning of the shaft, for example by engaging a screwdriver at the head.

The head can be disposed in a recess of a wall lying opposite the wall supporting the shaft, with the recess being provided in a rim which is approximately concentric to the head and is provided with latch cut-outs into which radial latching projections of the head engage. To be able to rotate the radial latching projections of the head so that they can latch into different latch cut-outs of the rim, the housing-like end piece consists of elastic material, for example plastic. With this design, a once set vertical adjustment of the slider can be fixed.

The recess can merge into a cut-out guiding the slider by a ring step, with the peripheral area of the ring step having a stop limiting the angle of rotation of the eccentric member. In this way, the set position cannot be lost by an accidental over-turning of the eccentric member.

For the simple connection of the housing-like end piece to the cut-out end of the runway, the end can be disposed in an angled cut-out of the end piece.

In accordance with a third embodiment of the invention, each of the front end regions of the horizontal runways is removed by a cutting out, with the rear part of a two-part end piece, whose lower side forms a support surface flush with the support surface of the runway, being connected to each of the vertical webs of the pullout rails and which is connected to the front part, whose lower sided continues the support surface, by a film hinge-like transition or a flexible thin point, and with an adjustment device, which pivots the front part about the film hinge-like transition or about the thin point, being connected to the vertical web. In this embodiment, the drawer can be adjusted in its height by a pivoting of the front part of the two-part end piece. To ensure the required flexibility of the thin point, the one-piece, two-part end piece consists of an elastic material such as plastic.

The adjustment device appropriately consists of an eccentric member.

The rear part of the two-part end piece can be pushed onto a limb bent from the vertical web of the pullout rail for its holding.

The front part of the two-part end piece is appropriately guided on a tongue bent from the vertical web of the pullout rail in accordance with the pivoting effected by the adjustment device.

The junction between the cut-out edge of the horizontal runway and of the end piece appropriately extends obliquely in order to avoid a junction causing noise when running over the supporting roller.

BRIEF DESCRIPTION OF THE DRAWINGS

Embodiments of the invention with further details and advantages will be explained in more detail in the following with reference to the drawing. There are shown in this FIG. 1 a side view of the front region of the drawer.

DESCRIPTION OF THE PREFERRED EMBODIMENTS

Figure 1:
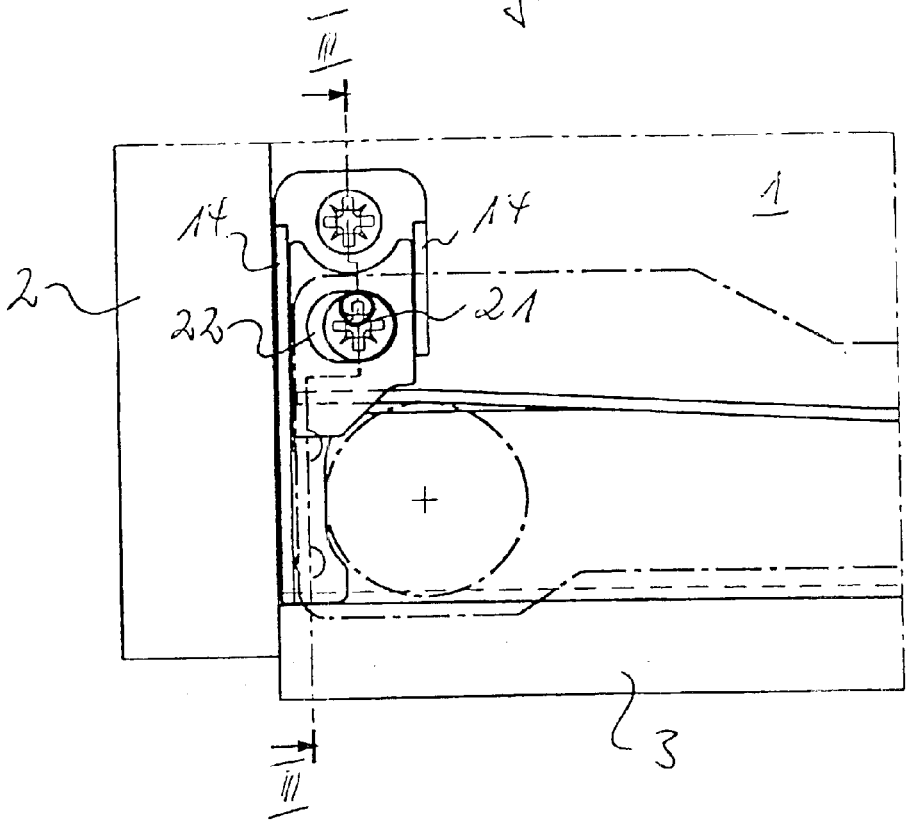
Figure 2:
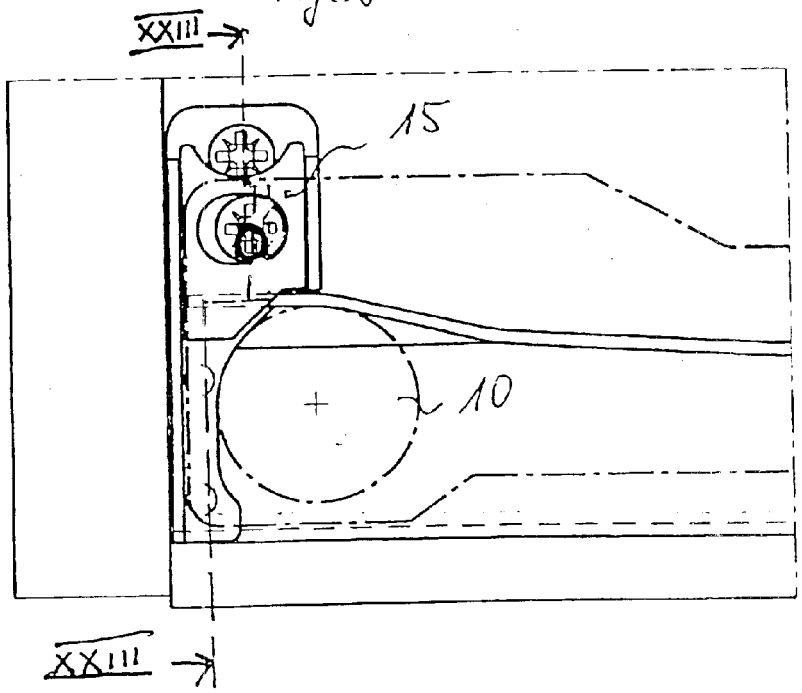
FIG. 2 a representation of the drawer corresponding to FIG. 1 in which its front cover is lowered downwards.

The front cover 2 is connected in a usual manner, not shown here, to the side walls 1 of a drawer, of which only the right hand one is shown. In the pushed-in condition, the front cover 2 abuts support walls of a piece of furniture, of which only a left hand support wall 3 is shown in FIGS. 1 and 2.

Figure 3:
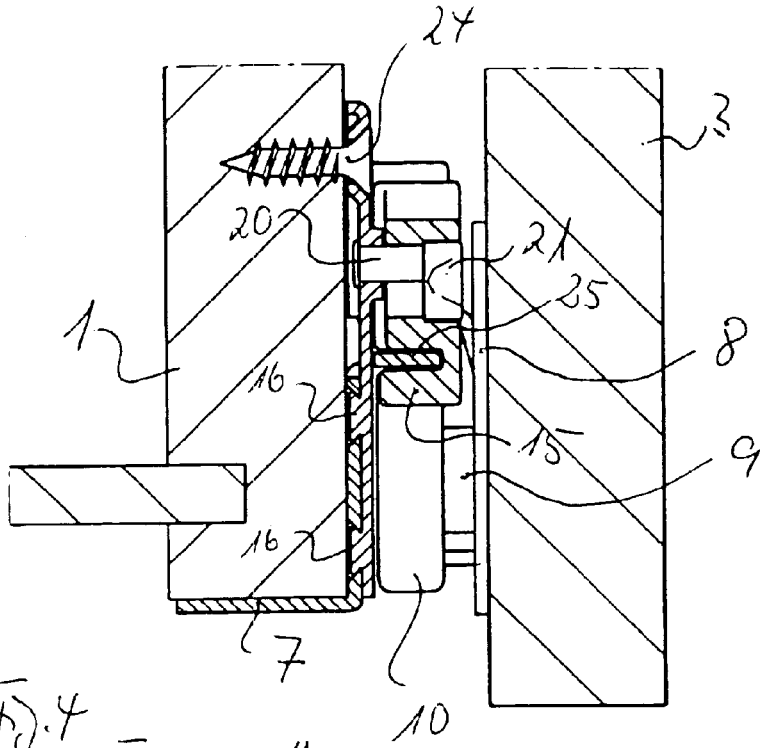
FIG. 3 a section through a drawer part along the line III—III in FIG. 1.
Figure 4:
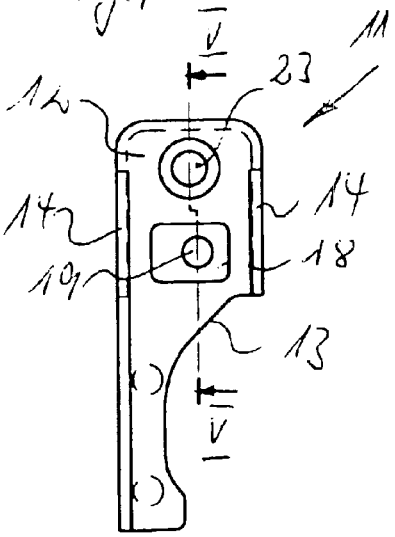
FIG. 4 a side view of the slider guide prior to riveting to a pullout rail of the drawer.
Figure 5:
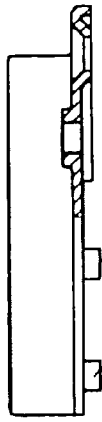
FIG. 5 a section through the slider guide along the line V—V in FIG. 4.
Figure 6:
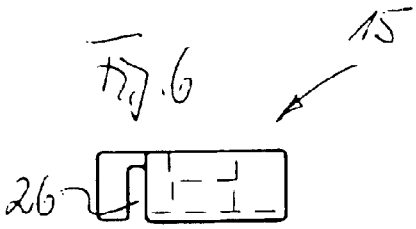
FIG. 6 a side view of the slider.
Figure 7:
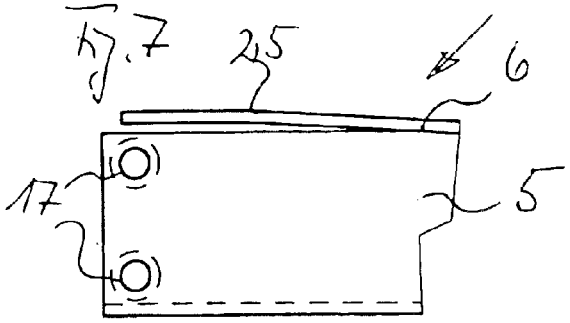
FIG. 7 a view of the front part of the pullout drawer.

The pullout rail 4, which consists of a vertical web 5 from which the upper runway 6 is bent approximately at right angles, is secured to the side wall 1 of the drawer. A lower, bent limb 7 of the pullout rail 4 engages behind the side wall 1 of the drawer. The carrier rails 8 at the body side are secured to the side body walls 3 and carry journals 9 on which the rollers 10 on the body side are rotatably supported on which the horizontal runways 6 of the two pullout rails 4 are supported. Slider guides 11 are connected to the front ends of the two pullout rails 5. The slider guides 11 consist of a substantially rectangular base board 12 which is provided in its lower region with an arc-shaped cut-out 13. Laterals webs 14, which extend parallel to one another and form the lateral guides for the slider 15, are connected to the sides of the base board 12 of the slider guide 11. The base board 12 of the slider guide is provided with rivets 16 which pass through countersinks 17 of the web 5 of the pullout rail 4 and are riveted in these in the manner visible from FIG. 3. The base board 12 of the slider guide 11 is provided in its upper region with a base-like elevation 18 which passes through a bore 19. A shaft 20 provided with a rivet head is rotatably held in the bore 19 and eccentrically carries a cylindrical disc shaped head 21. The cylindrical disc shaped head 21 is provided with a cross recess 22 for the engagement of a screwdriver and lies in the part of a transversely extending elongate bore 22 of the slider 15 widened by a step. Since the cylindrical disc shaped head 21 is supported on steps of the bore 22, the slider 15 is clamped between the rivet head of the shaft 20 and the cylindrical disc shaped head 21 and is held vertically displaceable on the slider guide 11. The slider guide 11 is provided at its upper end with a securing bore 23 for a securing screw 24.

The front end region 25 of the horizontal runway 6 is separated from the vertical web 5 of the pullout rail by a cut or slot. The slider 15 is provided in its lower end region with a transversely extending groove 26 in which the front part of the cut-out section 25 of the runway 6 is held in the manner visible from FIG. 3. If the cylindrical disc shaped head 21 is turned by a screwdriver, which is possible only with a slightly pulled out drawer, the slider 15 is vertically adjusted in the slider guide 11 so that the cut-out section 25 of the horizontal runway 6 is pivoted relative to the web 5. The front cover 2 can be adjusted relative to the support walls 3 by this pivoting because the cut-out part of the runway is supported at different heights on the front rollers 10 of the carrier rails 8 which are shown in chain-dotted lines in FIGS. 1 and 2.

The cut-out section 25 of the runway 6 is provided with a slight bend so that the free end of the cut-out section extends approximately parallel to the vertical web 5.

In the embodiment in accordance with FIGS. 8 to 15, a pullout rail 4, whose horizontal runway is cut out in its end region, is screwed to each of the side walls in the drawer. The vertical web 31 of the pullout rail 4 is provided with a buttressing, longitudinally extending reinforcing crease 32. The vertical web 31 is provided in its end region with a lobe 33 which is upwardly extended and is provided with bores 34 for securing the housing-like end piece 35 which is provided with bores 36 which coincide with the bores 34. The connection is effected by the rivet passing through the coinciding bores 34, 36. The housing-like end piece 35 is provided with a central cut-out 37 which consists of a slot which merges over a step into a widened, slot-like section 38. The slider 39, whose cross-section corresponds to the contour of the slot 37, 38, is displaceably guided into the slot 37, 38. The eccentric member 41 is rotatably held in a bore 42 in the rear side wall 40 by riveting of its shaft. In this connection, the eccentric section 43 of the eccentric member 41 passes through a window-like aperture 44 of the slider. The head 45 of the eccentric member is provided with a slot for a screwdriver and is disposed in a recess 46 of the front wall 47 of the end piece which is provided with a peripheral wall 47' which is concentric to the head 45 and which has latch cut-outs 48 disposed opposite to one another. Opposite latching projections 49 which are formed as radial protrusions at the rim of the head 45 engage into these latch cut-outs. The housing-like end piece 35 consists of a plastic die-cast part which ensures the required elasticity so that the latching projections 49 can latch into the desired latch cut-outs 48 by rotation.

The recess 46 merges by a step 50 into the slot-like recess 47. This step-like transition is provided with a chord-like retraction 51 which forms a stop limiting the angle of rotation of the eccentric member 41.

Figure 8:
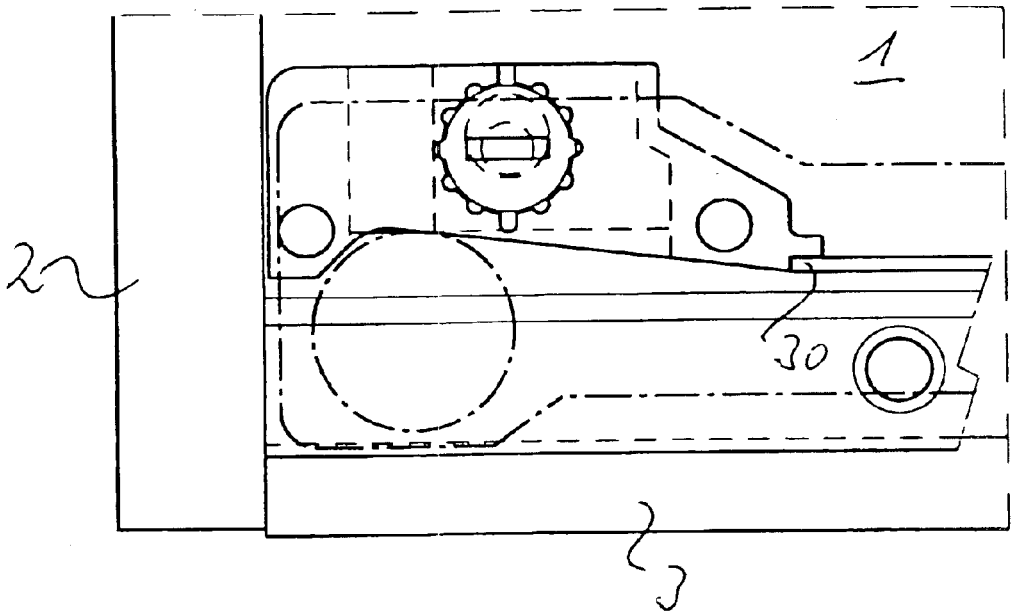
FIG. 8 a side view of the front region of the drawer corresponding to FIG. 1 having an end piece with a vertically adjustable slider, which has a lower support surface, held in the cut-out region of the horizontal runway.
Figure 9:
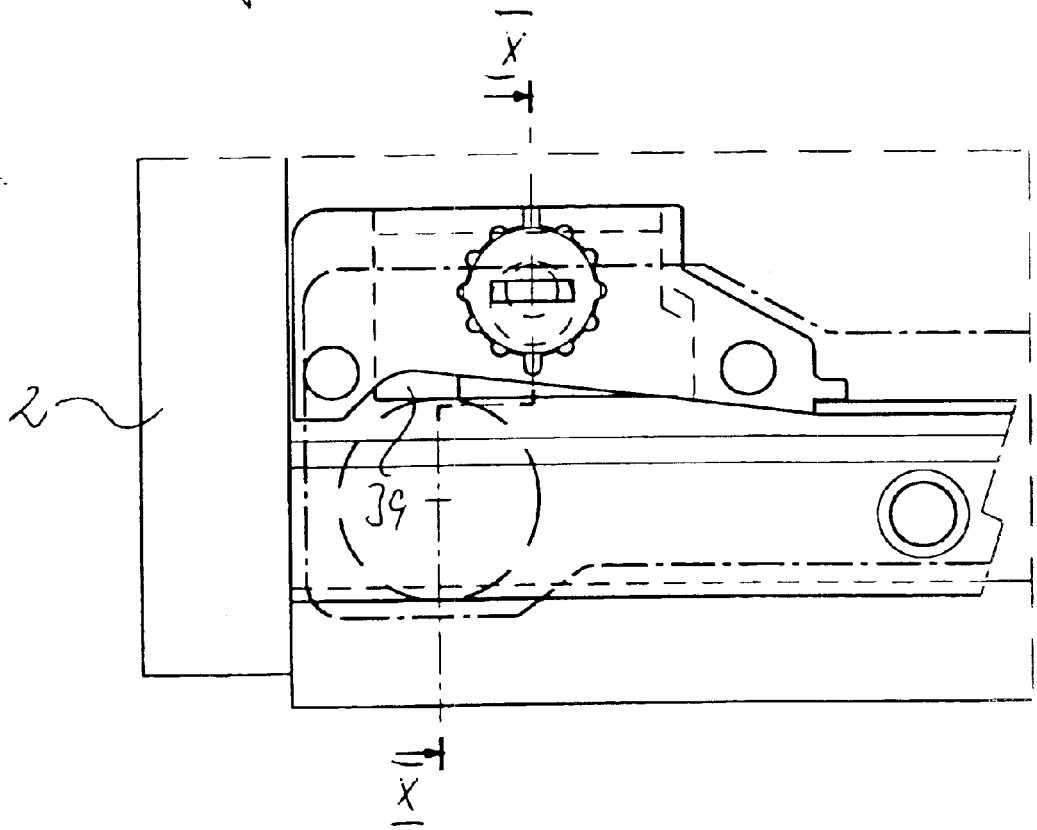
FIG. 9 a view corresponding to FIG. 8 with the slider travelled out for the vertical adjustment of the drawer.
Figure 10:
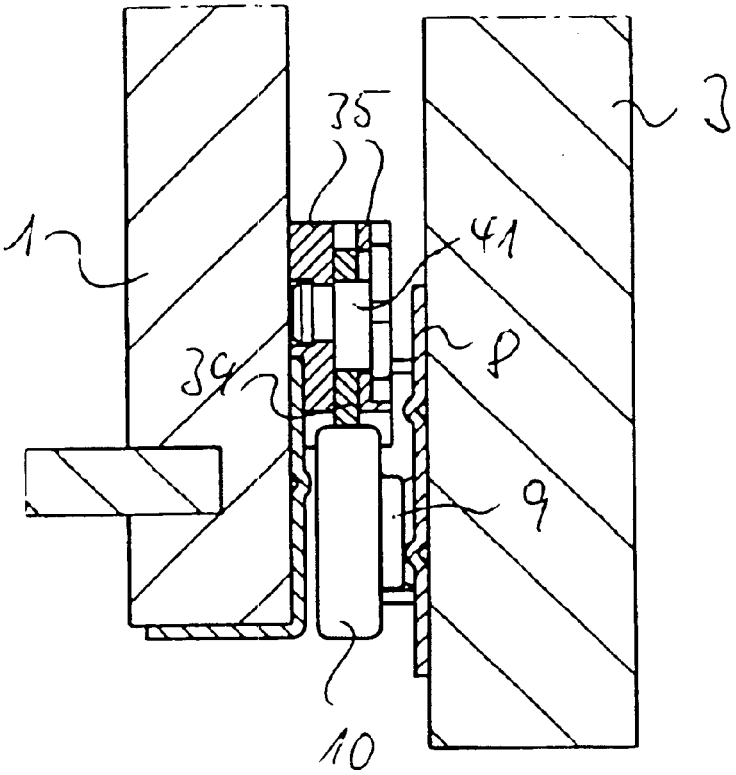
FIG. 10 a section through the carrier rail and the pullout rail with an end piece held on it along the line X—X in FIG. 9.
Figure 11:
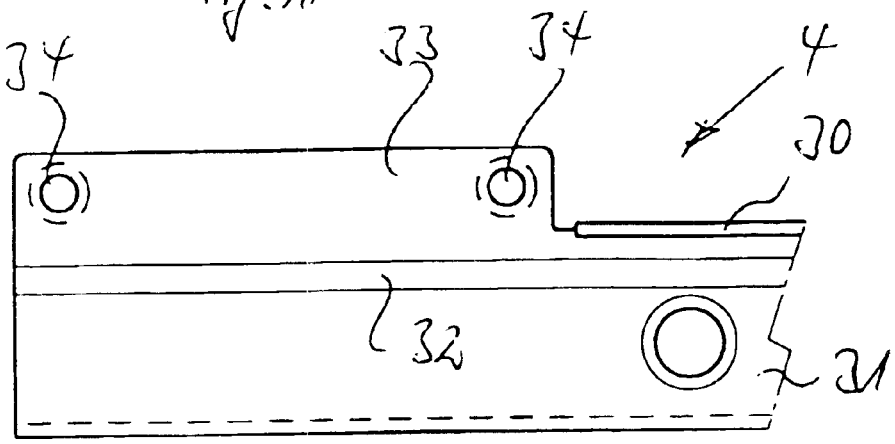
FIG. 11 a side view of the pullout rail in which the end region of the horizontal runway has been removed by a cutting-out.
Figure 12:
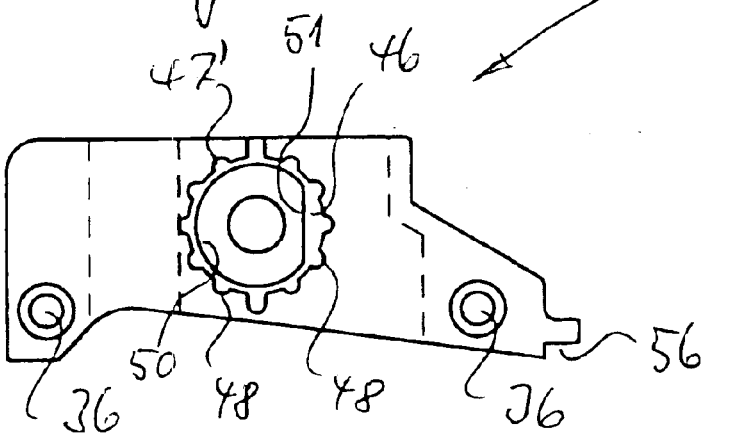
FIG. 12 a side view of the housing-like end piece detached from the pullout rail.
Figure 13:
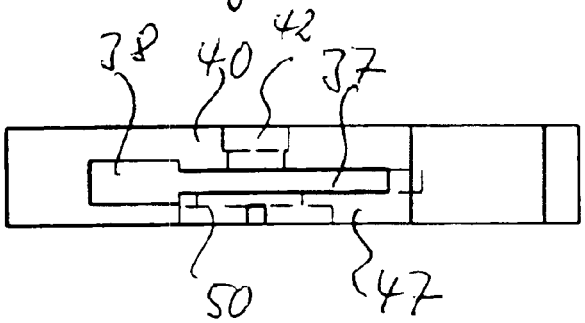
FIG. 13 a plan view of the end piece in accordance with FIG. 12.
Figure 14:
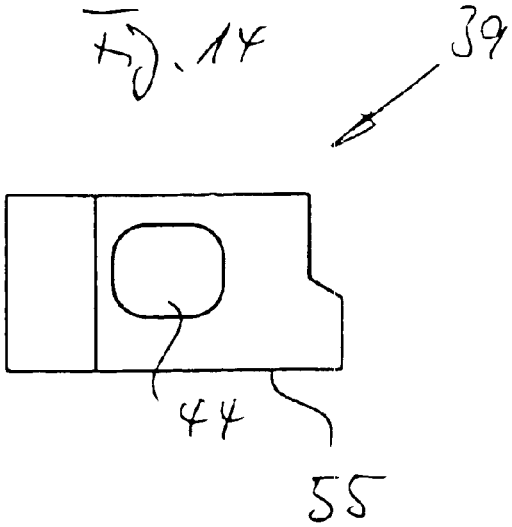
FIG. 14 a side view of the slider guided in a recess of the end piece in accordance with FIGS. 12 and 13.
Figure 15:
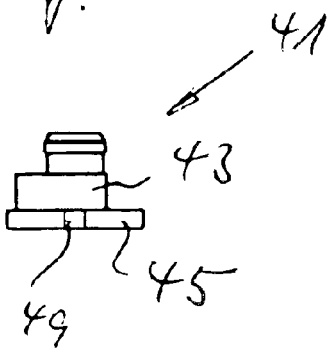
FIG. 15 a side view of the eccentric member to be riveted in a side wall of the end piece.
Figure 16:
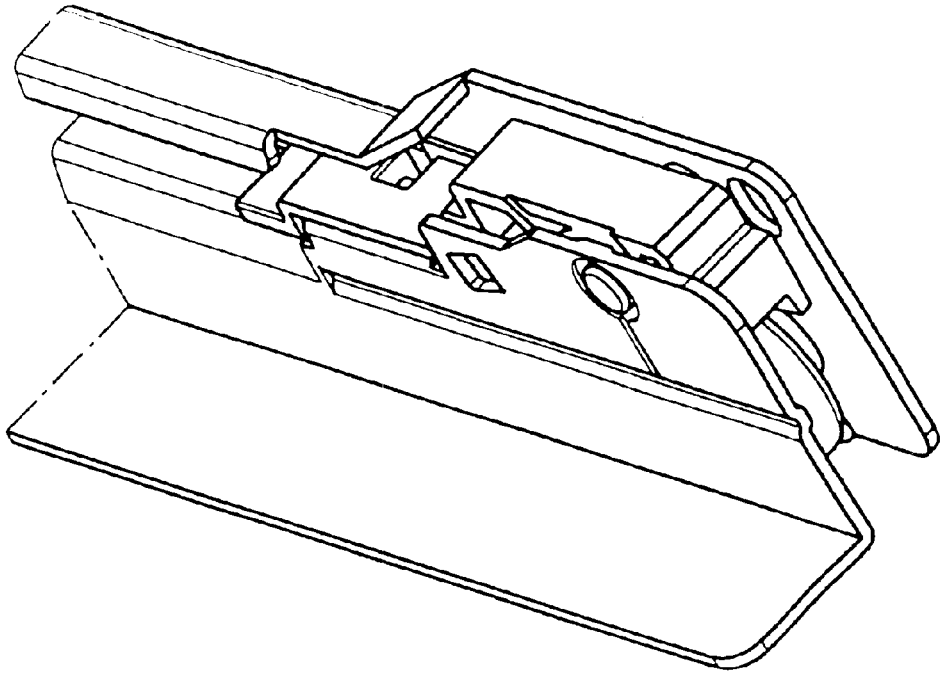
FIG. 16 a perspective view of a third embodiment of the invention having a two-part end piece.

When the eccentric member 41 is turned by a screwdriver, the slider 39 can be travelled out of its inserted position visible from FIG. 8 into its moved out position visible from FIG. 9 in which the lower side edge 55 forms the support surface for the roller 10 instead of the obliquely extending support surface of the end piece so that the front cover 2 of the drawer is raised with respect to its position visible from FIG. 8.

In the assembled state of the end piece visible from FIGS. 8 and 9, a step-shaped section 56 of the end piece encompasses the end region of the cut-out runway 30 so that the support surfaces of the runway 30 and of the end piece merge into one another smoothly.

In the third embodiment of the invention visible from FIG. 16 to 20, the lower support surface of the horizontal runway 60 is continued by the lower side of a two-part end piece 61. This two-part end piece consists of a rear part 62 which serves the securing and which is connected to the front part 64 by a film-hinge like transition or by a flexible thin point 63. In the region of the cut-out, a limb 66 is bent from the web part 65 of the pullout rail 5 and is divided by notches 67 into three parts which engage into openings 68 matched thereto of the rear part 62 of the two-part end piece 61 for its holding. The front part 64 of the two-part end piece 61 is provided with a window-like opening 69 through which an eccentric member 70 passes which is rotatably held at the web part 65 of the pullout rail 5 in that its spigot-like continuation 71 is riveted in a bore 72 of the web part 65 while maintaining rotatability. The window-like opening 69 is encompassed step-wise by a retraction 73 in which the head 74 of the eccentric member is disposed which is provided with a cross recess 75 for its turning with a screwdriver. The two-part end piece consists of a die-cast part made of plastic so that the thin point 63 has the required elasticity.

A tongue 75 is bent out of each vertical web 65 of the pullout rail; this tongue engages into a support surface formed by the recess 76 of the front part of the two-piece end piece and has an inclination such that when the front part is pivoted by turning the eccentric member 70, a guide is provided around the pivot axis formed by the thin point 63.

Figure 17:
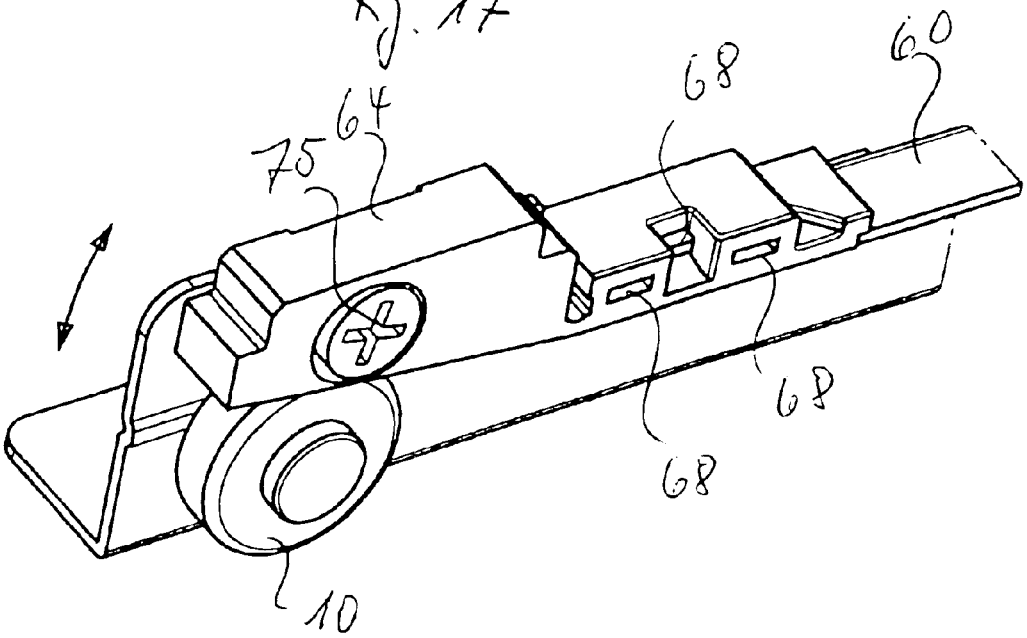
FIG. 17 a further perspective view of the two-part end piece in accordance with FIG. 16.
Figure 18:
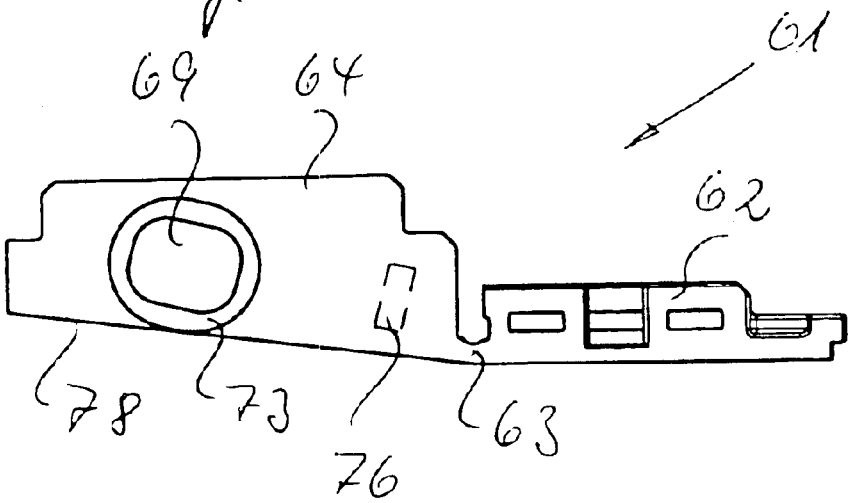
FIG. 18 a side view of the two-part end piece detached from the pullout rail.
Figure 19:
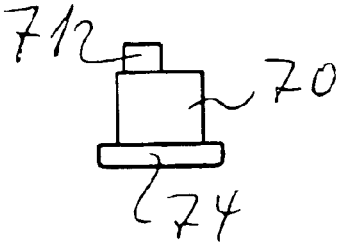
FIG. 19 a side view of an eccentric member to be riveted to the pullout rail.
Figure 20:
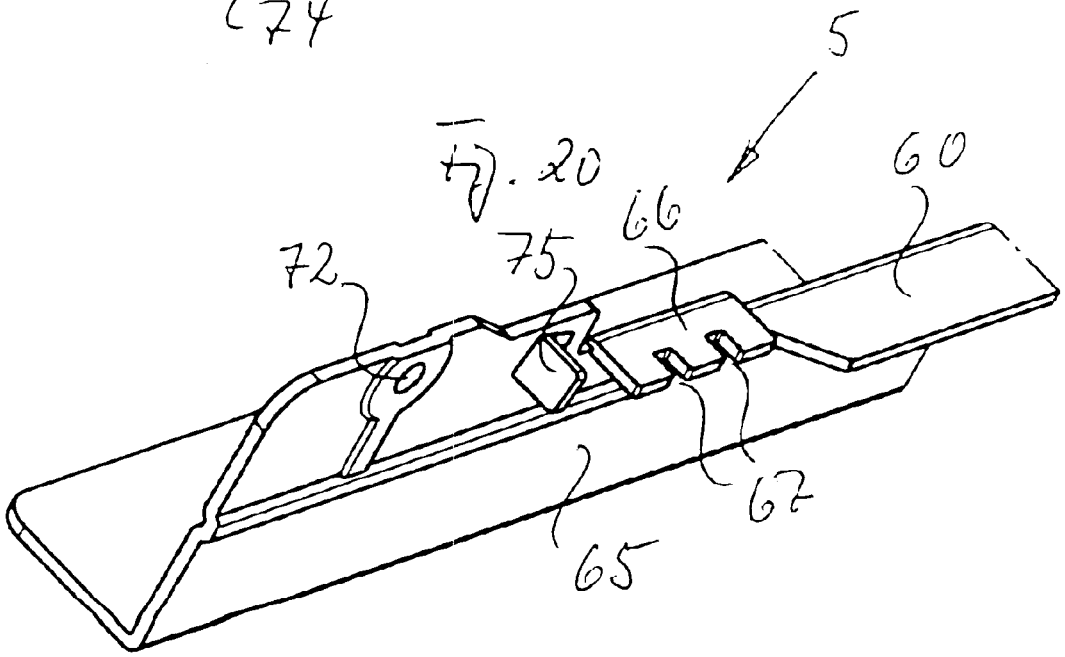
FIG. 20 a perspective view of the end region of the pullout rail to which the two-part end piece is to be connected.
Figure 22:
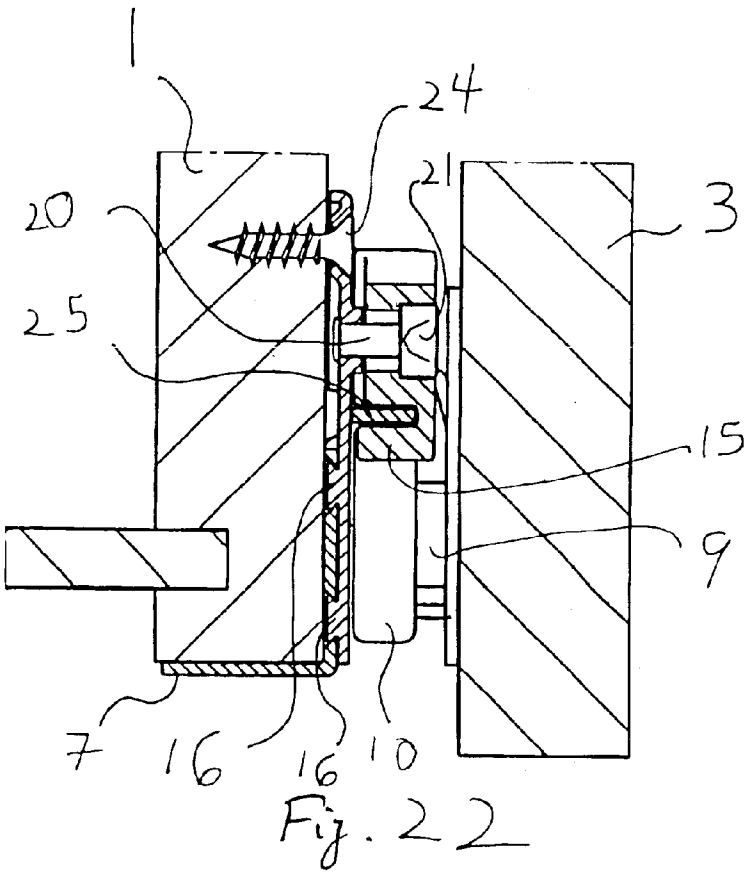
FIG. 22 a section, similar to FIG. 3, and through a drawer part along line XXII—XXII in FIG. 21.
Figure 21:
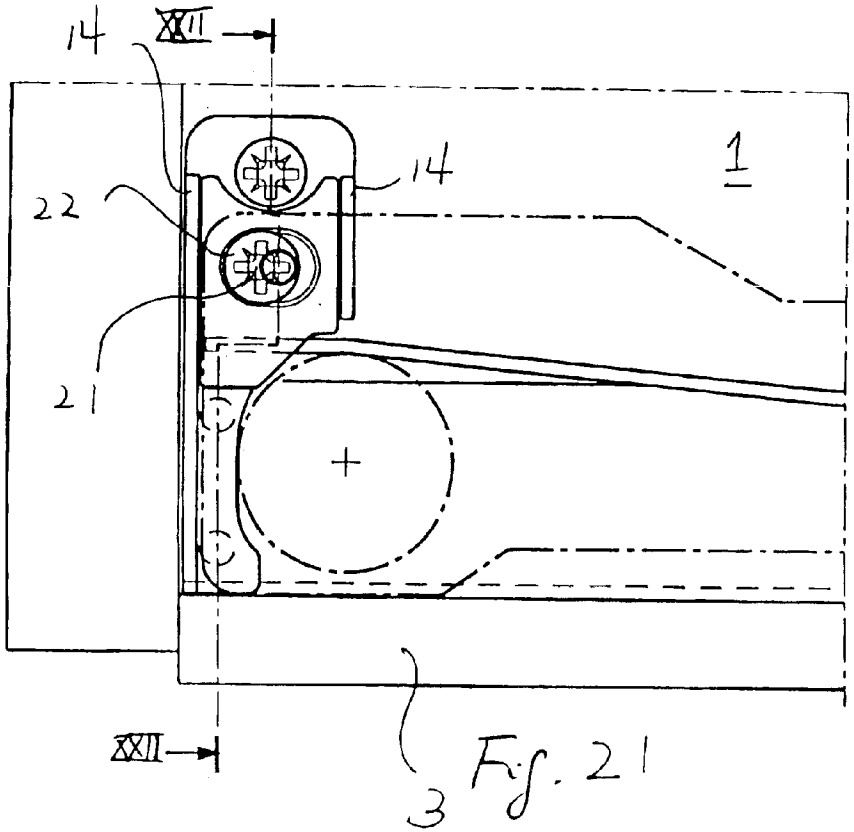
FIG. 21 a side view of the front end region of the drawer intermediate the raised and lowered positions shown in FIGS. 1 and 2.
Figure 23:
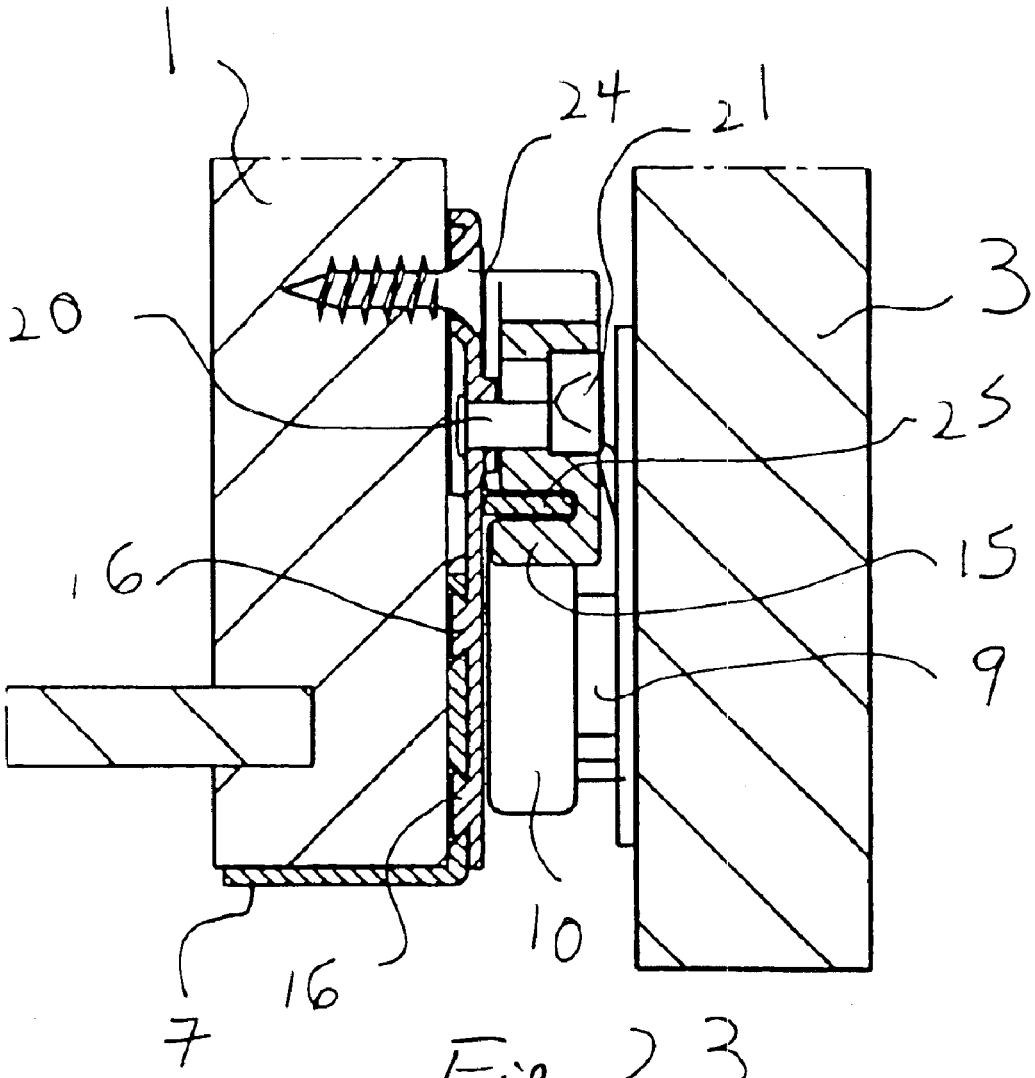
FIG. 23 a section, similar to FIGS. 3 and 22, and through a drawer part along line XXIII—XXIII in FIG. 2.

As can be seen from FIG. 17, the lower support surface of the runway 60 flushly adjoins the lower side of the rear part 62 of the two-part end piece, with a smooth transition to the lower support surface 78 of the front part 64 being created by the flexural point 63 such that a smooth running of the support rollers 10 is ensured when a pivoting of the front part 64 has taken place with respect to the rear part 62 for the vertical adjustment of the drawer.

The junction between the cut-out edge of the horizontally extending runway 60 and of the rear part 62 of the two-part end piece 61 extends obliquely to ensure a smooth running of this joint over the roller 10.

What is claimed is:

1. A pullout guide for a drawer having two carrier rails (8) respectively mounted upon opposite frame body side walls (3), rollers (10) being rotatably mounted upon the carrier rails (8) about respective axes, two pullout rails (4) respectively mounted upon opposite drawer side walls (1), each said rail (4) comprising a web (5) and runway (6) bent from an upper side of said web (5) and arranged to he supported, at lower surfaces thereof, upon the rollers (10) located in a front region of the frame body side walls (3) when the drawer is inserted into the frame body, wherein said runways (6) are provided, at front end regions (25) thereof, with sections arranged to be pivoted or moved by adjustment devices (11, 15, 20, 21).

2. The guide of claim 1, wherein the axes are horizontal, said runways (6) are horizontally disposed, and said webs (5) are vertically disposed when the drawer is inserted into the frame body, with said sections (25) being pivotal or vertically adjustable.

3. The guide of claim 1, wherein each said front end region (25) of said respective runways (6) is cut out from said respective webs (5) of the pullout rails (4) and is provided with a respective adjustment device (11, 15, 20, 21) for pivoting the cutout end regions (25) of each said runway (6) with respect to said respective webs (5).

4. The guide of claim 1, wherein each said adjustment device (11, 15, 20, 21) comprises a slider (15) arranged to be displaceable transversely to a respective pullout rail (4) and comprising a groove (26) arranged to encompass a respective cutout end region (25) of each said runway (6) and a respective displacement device (11, 20, 21).

5. The guide of claim 1, wherein each said adjustment device (11, 15, 20, 21) comprises a slider (15) provided with a transversely-extending elongate opening (22), a guide piece (11) connected to a respective pullout rail (4) and comprising lateral guide webs (14) in which said slider (15) is positioned and guided, and a cylindrical disc (21) and shaft (20) eccentrically secured thereto, with said opening (22) having sides enclosing said disc (21) and said shaft (20) being rotatably and nonaxially displaceably held by said guide piece (11).

6. The guide of claim 3, wherein each said adjustment device (11, 15, 20, 21) comprises a slider (15) arranged to be displaceable transversely to a respective pullout rail (4) and comprising a groove (26) arranged to encompass a respective cut out end region (25) of each said runway (6) and a respective displacement device (11, 20, 21).

7. The guide of claim 3, wherein each said adjustment device (11, 15, 20, 21) comprises a slider (15) provided with a transversely-extending elongate opening (22), a guide piece (11) connected to a respective pullout rail (4) and comprising lateral guide webs (14) in which said slider (15) is positioned and guided, and a cylindrical disc (21) and shaft (20) eccentrically secured thereto, with said opening (22) having sides enclosing said disc (21) and said shaft (20) being rotatably and nonaxially displaceably held by said guide piece (11).

8. The guide of claim 4, wherein each said adjustment device comprises:

a guide piece (11) connected to a respective pullout rail (4) and comprising lateral guide webs (14) in which said slider (15) is positioned and said slider (15) comprising a transversely-extending elongate opening (22), and a cylindrical disc (21) and shaft (20) eccentrically secured thereto, with said opening (22) having sides enclosing said disc (21) and said shaft (20) being rotatably and nonaxially displaceably held by said guide piece (11).

9. The guide of claim 6, wherein each said adjustment device comprises:

a guide piece (11) connected to a respective pullout rail (4) and comprising lateral guide webs (14) in which said slider (15) is positioned and guided and said slider (15) comprises a transversely-extending elongate opening (22), and a cylindrical disc (21) and shaft (20) eccentrically secured thereto, with said opening (22) having sides enclosing said disc (21) and said shaft (20) being rotatably and nonaxially displaceably held by said guide piece (11).

10. The guide of claim 5, wherein said guide piece (11) comprises a substantially rectangular base board (12) provided in a lower region with an arc-shaped cutout (13) to accommodate a respective roller (10).

11. The guide of claim 7, wherein said guide piece (11) comprises a substantially rectangular base board (12) provided in a lower region with an arc-shaped cutout (13) to accommodate a respective roller (10).

12. The guide of claim 8, wherein said guide piece (11) comprises a substantially rectangular base board (12) provided in a lower region with an arc-shaped cutout (13) to accommodate a respective roller (10).

13. The guide of claim 9, wherein said guide piece (11) comprises a substantially rectangular base board (12) provided in a lower region with an arc-shaped cutout (13) to accommodate a respective roller (10).

* * * * *